US010870107B2

(12) United States Patent
Setzer et al.

(10) Patent No.: US 10,870,107 B2
(45) Date of Patent: Dec. 22, 2020

(54) METHOD FOR DETECTING THE TYPE OF AN EXCHANGEABLE PISTON-CYLINDER UNIT FOR A DISPENSER

(71) Applicant: BRAND GMBH + CO KG, Wertheim (DE)

(72) Inventors: Daniel Setzer, Wertheim (DE); Jürgen Schraut, Rettersheim (DE); Renate Rempt, Wertheim (DE); Rainer Feldmann, Rimpar (DE)

(73) Assignee: BRAND GMBH + CO KG, Wertheim (DE)

( * ) Notice: Subject to any disclaimer, the term of this patent is extended or adjusted under 35 U.S.C. 154(b) by 179 days.

(21) Appl. No.: 16/312,407

(22) PCT Filed: Feb. 22, 2018

(86) PCT No.: PCT/EP2018/054386

§ 371 (c)(1),
(2) Date: Feb. 11, 2019

(87) PCT Pub. No.: WO2018/153986

PCT Pub. Date: Aug. 30, 2018

(65) Prior Publication Data

US 2019/0160458 A1 May 30, 2019

(30) Foreign Application Priority Data

Feb. 23, 2017 (DE) ..... 20 2017 101 007 U

(51) Int. Cl.
*B01L 3/02* (2006.01)

(52) U.S. Cl.
CPC ..... *B01L 3/0234* (2013.01); *B01L 3/0279* (2013.01); *B01L 2200/143* (2013.01); *B01L 2300/021* (2013.01); *B01L 2400/0478* (2013.01)

(58) Field of Classification Search
CPC ..... B01L 3/0234; B01L 3/0279; B01L 2200/143; B01L 2300/021; B01L 2400/0478
See application file for complete search history.

(56) References Cited

U.S. PATENT DOCUMENTS 4,750,373 A * 6/1988 Shapiro ..... B01L 3/0234 73/864.87
4,988,481 A * 1/1991 Jarvimaki ..... B01L 3/0224 422/511

(Continued)

FOREIGN PATENT DOCUMENTS

DE 4342178 A1 6/1995
DE 19915771 C1 1/2001

(Continued)

*Primary Examiner* — David J Bolduc
(74) *Attorney, Agent, or Firm* — David S. Safran; Roberts Calderon Safran & Cole, P.C.

(57) ABSTRACT

A method for detecting the type of an exchangeable piston-cylinder unit for a dispenser, to a piston-cylinder unit having at least one radially oriented information carrier section, and at least one axially oriented information carrier section, both of which at least partially specifies the type of piston-cylinder unit, and to a dispenser having an acquisition device for automatically identifying the type of piston-cylinder unit arranged on the dispenser. The method has at least the following steps: a) detachably mounting the piston-cylinder unit on the dispenser by at least an axial movement; b) detecting completion of a successful mounting of the piston-cylinder unit on the dispenser with a sensor device; c) detecting an information of the axially oriented information carrier section; d) detecting an information of the radially oriented information carrier section; and e) determining the type of the piston-cylinder unit mounted on the dispenser from the detected information.

38 Claims, 5 Drawing Sheets

(56) References Cited

U.S. PATENT DOCUMENTS

| | | | | | |
|---|---|---|---|---|---|
| 5,002,737 | A * | 3/1991 | Tervamaki | B01L 3/0224 | 222/386 |
| 5,620,661 | A | 4/1997 | Schürbrock | | |
| 5,983,733 | A * | 11/1999 | Strandberg | B01L 3/0224 | 73/1.74 |
| 6,984,222 | B1 | 1/2006 | Hitchins et al. | | |
| 7,033,543 | B1 * | 4/2006 | Panzer | B01L 3/0279 | 422/525 |
| 8,114,361 | B2 | 2/2012 | Reichmuth | | |
| 2001/0019701 | A1 | 9/2001 | Braun et al. | | |
| 2010/0266454 | A1 * | 10/2010 | Reichmuth | B01L 3/0279 | 422/501 |
| 2011/0088493 | A1 * | 4/2011 | Blumentritt | B01L 3/0234 | 73/864.17 |
| 2014/0051182 | A1 * | 2/2014 | Reichmuth | B01L 3/021 | 436/180 |
| 2014/0137792 | A1 * | 5/2014 | Ward | G09F 3/0291 | 116/200 |

FOREIGN PATENT DOCUMENTS

| | | | | | |
|---|---|---|---|---|---|
| DE | 102011114591 | B3 | 12/2012 | | |
| DE | 102011114688 | A1 | 4/2013 | | |
| EP | 0691158 | A2 | 1/1996 | | |
| EP | 2783753 | A1 | 10/2014 | | |
| WO | WO-2004052543 | A1 * | 6/2004 | B01L 3/0217 | |
| WO | WO-2013045013 | A1 * | 4/2013 | B01L 3/0217 | |
| WO | 2014204587 | A1 | 12/2014 | | |

* cited by examiner

METHOD FOR DETECTING THE TYPE OF AN EXCHANGEABLE PISTON-CYLINDER UNIT FOR A DISPENSER

FIELD OF THE INVENTION

The invention relates to a method for detecting the type of an exchangeable piston-cylinder unit for a dispenser. The invention also relates to an exchangeable piston-cylinder unit for a dispenser, to a dispenser on which a piston-cylinder unit can be releasably mounted and to a system for receiving and dispensing fluid volumes for receiving and dispensing fluid volumes having an exchangeable piston-cylinder unit.

DESCRIPTION OF THE RELATED ART

The purpose of systems of the type in question is to receive a fluid volume from a container and then to dispenser it into another or several other containers. Such systems are used, in particular, for repeated dispensing, titration or pipetting of liquids.

Such systems comprise a dispenser and a piston-cylinder unit, which is designed as an exchangeable part and can be mounted releasably on the dispenser, in particular can be inserted or placed therein. After one or more dispensing procedures, the piston-cylinder unit can be released from the dispenser. Some other, in particular a different, piston-cylinder unit can then be mounted on the dispenser.

Such systems can be designed as manual or motor-operated handheld devices, on the dispenser of which precisely one piston-cylinder unit can be mounted. There are also systems on the dispenser of which a multiplicity of piston-cylinder units can be mounted simultaneously, e.g., in an automatic pipetting device.

Piston-cylinder units of the type in question can be designed as positive displacement units with attachable pipettes or tips or can be designed as syringes, for example. In each case, they have a cylinder, in particular a cylinder comprising a right hollow cylinder with a cross section substantially in the form of a circular ring and an axial direction perpendicular thereto, and a piston that can be moved in the cylinder in the axial direction thereof. By moving the piston, it is possible to take up fluids into the cylinder or into the tip fitted therein and to dispenser said fluids therefrom.

SUMMARY OF THE INVENTION

The essential point for the present invention is that the piston-cylinder units can be mounted on the dispenser by means of a movement at least substantially in the axial direction of the dispenser. This allows simple, user-friendly and ergonomically advantageous operation of the corresponding system with little susceptibility to error. Here, the expression "axial direction of the dispenser" denotes an axial direction corresponding to or parallel to the longitudinal axis of the dispenser.

In this context, the focus of the present invention is on piston-cylinder units which operate on the direct displacement principle and are suitable for dispensing liquids of high viscosity and/or a high vapor pressure.

For the systems of relevance here, it is advantageous to be able to automatically detect the type of a piston-cylinder unit. Here, the term "type" denotes, for example, a purpose, a state and/or a property of the piston-cylinder unit, e.g., the maximum fluid volume that can be received and/or dispensed.

A method for detecting the type of an exchangeable piston-cylinder unit for a dispenser is known in practice. In this case, the piston-cylinder unit has a plurality of information carrier sections. The overall information carried by all the information carrier sections specifies the type of the piston-cylinder unit. Here, all the information carrier sections are oriented radially, i.e., the information item(s) of an information carrier section is/are encoded in the radial direction thereof. All the information carrier sections are arranged on a flange of the cylinder of the respective piston-cylinder unit. The dispenser has an acquisition device for automatically identifying the type of a piston-cylinder unit mounted on the dispenser. The acquisition device has a radial information reader, by means of which the information of the radially oriented information carrier sections can be acquired.

The known method comprises the following method steps:

releasable mounting of the piston-cylinder unit on the dispenser by means of a movement at least substantially in the axial direction of the dispenser, detecting the completion of a successful mounting of the piston-cylinder unit on the dispenser, and acquiring an information item of the radially oriented information carrier sections.

It is an object of the present invention to improve the known method and the associated system and the known dispenser and the known piston-cylinder unit in respect of reliability, precision, processes, construction, handling, stability and/or durability.

According to a first, second, third and fourth aspect of the invention, respectively, the above-stated object is achieved respectively by the method, by an exchangeable piston-cylinder unit for a dispenser, by a dispenser, and by a system for receiving and dispensing fluid volumes as described herein below.

It is self-evident that refinements, embodiments, advantages and the like which are presented below only in relation to one aspect of the invention for the sake of avoiding repetition apply once the necessary changes have been made to the other aspects of the invention.

Given the above, the present invention is described in greater detail below.

One basic concept of the present invention is that of combining at least two different possibilities for encoding information. Here, it has proven particularly advantageous to combine radial encoding of information with axial encoding of information.

Thus, according to the first aspect of the invention, the piston-cylinder unit has at least one radially oriented information carrier section, which at least partially specifies the type of the piston-cylinder unit, and at least one, preferably only one, axially oriented information carrier section, which at least partially specifies the type of the piston-cylinder unit.

Here, the expression "radially oriented information carrier section" should be taken to mean that this information carrier section is accessible in the radial direction of the piston-cylinder unit and/or the information thereon can be acquired in the radial direction of the piston-cylinder unit. The radially oriented information carrier section has a geometrical extent in the radial direction of the piston-cylinder unit by means of which the acquirable information of the radial information carrier section is encoded. Moreover, the radially oriented information carrier section has a geometrical extent in the axial direction of the piston-cylinder unit and in the circumferential direction of the piston-cylinder unit.

Here, the expression "axially oriented information carrier section" should be taken to mean that this information carrier section is accessible in the axial direction of the piston-cylinder unit and/or the information thereon can be acquired in the axial direction of the piston-cylinder unit. The axially oriented information carrier section has a geometrical extent in the axial direction of the piston-cylinder unit by means of which the acquirable information of the axial information carrier section is encoded. Moreover, the axially oriented information carrier section has a geometrical extent in the radial direction of the piston-cylinder unit and in the circumferential direction of the piston-cylinder unit.

The piston-cylinder unit according to the invention with geometrically predetermined dimensions allows a compact construction and, even in the case of a high number of information carrier sections, secure fastening on the dispenser and slip-free driving of the piston by the dispenser. It is likewise possible for manufacturing tolerances to be greater, and thus the production of the piston-cylinder unit according to the invention is less expensive.

The information of the radially oriented information carrier section and of the axially oriented information carrier section preferably jointly specify the type of the piston-cylinder unit. In the case where there is a plurality of radially oriented information carrier sections, it is additionally possible for the information from all the radially oriented information carrier sections to jointly specify the type of the piston-cylinder unit. Thus, the type of the piston-cylinder unit could be identified both by means of a dispenser which acquires only the information of the radially oriented information carrier sections and by means of a dispenser which acquires the information of at least one axially oriented information carrier section and at least one radially oriented information carrier section.

The information carrier sections can jointly specify a subtype, that is to say, for example, a purpose, a state or a property. However, it is also possible for each of the information carrier sections to separately specify one subtype. Thus, one information carrier section can specify one subtype, e.g., a property, and another information carrier section can specify another subtype, e.g., a state. The situation can also be such that the information carrier sections each specify a characteristic of the same subtype, that is to say one information carrier section specifies a first property and another information carrier section specifies a second property.

The axially oriented information carrier section and/or the radially oriented information carrier section or all the information carrier sections is/are preferably provided on a piston head of the piston-cylinder unit. The two information carrier sections can be arranged in overlap in the axial direction. Here, the term "piston head" denotes the part of the piston of the piston-cylinder unit which is outside the cylinder when a piston has been pushed into the cylinder to the maximum extent. The drive of the dispenser acts on the piston head.

It is preferred if the axially oriented information carrier section is formed by a recess, in particular a groove, in the piston head, the recess extending in the axial direction of the piston-cylinder unit. The recess extends in the axial direction, starting from one end face of the piston head. In this way, recesses of relatively great depth can be implemented without significant disadvantages in respect of the stability of the piston.

The term "groove" should be taken to mean that the recess extending in the axial direction of the piston-cylinder unit is not completely surrounded by piston head material in the radial direction of the piston-cylinder unit, but is partially open in the radial direction, preferably along the entire depth of the recess. Such a configuration makes it easier to clean the recess and offers a simple possibility of inspection.

It has proven advantageous if the radially oriented information carrier section is formed by a recess on the piston head, the recess extending in the radial direction of the piston-cylinder unit and preferably running around in the circumferential direction of the piston-cylinder unit. If there is a plurality of radially oriented information carrier sections, the remaining radially oriented information carrier sections are each formed by a recess on the piston head, each recess extending in the radial direction of the piston-cylinder unit and preferably running around in the circumferential direction of the piston-cylinder unit. Particularly in the case of recesses running around in the circumferential direction of the piston-cylinder unit, the radially oriented recesses can be arranged on the piston head in a manner offset relative to one another in the axial direction of the piston-cylinder unit. This allows a configuration which is compatible with piston-cylinder units that have exclusively radially oriented information carrier sections.

The information carrier sections are preferably designed in such a way that the depth of the axially oriented recess (extent in the axial direction) and the depth of the radially oriented recess (extent in the radial direction) specify the type of the piston-cylinder unit. This is a simple way of encoding relatively large amounts of information. Moreover, it allows simple and precise acquisition of the encoded information with little susceptibility to error and thus allows a simple and low-cost construction of the acquisition device of the dispenser.

If there is a plurality of radially oriented information carrier sections, the radially oriented information carrier sections can be designed in such a way that the depth, number, arrangement in the axial direction of the piston-cylinder unit and/or the respective width of the radially oriented recesses (also) specify the type of the piston-cylinder unit.

The piston head preferably has a fastening section, at which a piston actuator of the dispenser can engage the piston head. This fastening section is preferably arranged at least in part separately from the information carrier sections. There can also be an overlap between the fastening section and information carrier sections.

Precisely if the information carrier sections are provided on the piston head of the piston-cylinder unit, the combination according to the invention of the axially oriented information carrier section/s and the radially oriented information carrier section/s makes it possible to arrange a fastening section on the piston head in such a way that the piston head is of compact configuration and the piston can be moved by means of the piston actuator in a precise manner and without significant deformation of the piston head. For this purpose, the radially oriented information carrier section/s is/are preferably arranged in the axial direction between the end face of the piston head and the fastening section.

According to the second aspect of the invention, the piston-cylinder unit has at least one, preferably precisely one, axially oriented information carrier section, which partially specifies the type of the piston-cylinder unit, and a fastening section. The axially oriented information carrier section and the fastening section are provided on a piston head of the piston-cylinder unit, wherein the fastening section is arranged separately from the axially oriented information carrier section, and, in particular, is arranged offset in the axial direction of the piston-cylinder unit. The fastening section is designed in such a way that a piston actuator of the dispenser can engage the piston head at said fastening section.

The piston-cylinder unit according to the invention allows stable fixing of the piston head by the piston actuator without significant deformations of the piston head.

It is preferred if the axially oriented information carrier section is formed by a recess, in particular groove, in the piston head, the recess extending in the axial direction of the piston-cylinder unit. The recess extends in the axial direction, starting from one end face of the piston head. It is preferred if the depth of the recess in the axial direction partially specifies the type of the piston-cylinder unit.

The fastening section is preferably arranged below the axially oriented information carrier section in the axial direction, i.e. between the axially oriented information carrier section and the cylinder of the piston-cylinder unit.

At least one radially oriented information carrier section, which partially specifies the type of the piston-cylinder unit and is preferably arranged separately from the axially oriented information carrier section and/or the fastening section, is preferably also provided on the piston head. In this way, the radially oriented information carrier section can be arranged between the end face of the piston head or the axially oriented information carrier section and the fastening section in the axial direction of the piston-cylinder unit. It is also possible for the radially oriented information carrier section and the axially oriented information carrier section to be arranged in partial overlap in the axial direction of the piston-cylinder unit.

The axially oriented information carrier section and/or the radially oriented information carrier section/s is/are preferably designed as described above in relation to the first aspect of the invention.

As regards the dispenser according to the invention (third aspect of the invention), it is essential that a piston-cylinder unit, in particular a piston-cylinder unit as described above, can be releasably mounted thereon by means of a movement at least substantially in the axial direction of the dispenser.

The dispenser according to the invention has an acquisition device for automatically identifying the type of a piston-cylinder unit mounted on the dispenser. The acquisition device has an axial information reader, by means of which an information item of an axially oriented information carrier section of the piston-cylinder unit can be acquired. Moreover, the acquisition device has a radial information reader, by means of which an information item of a radially oriented information carrier section of the piston-cylinder unit can be acquired. Thus, the dispenser according to the invention is designed in such a way that it can identify the type of a piston-cylinder unit mounted thereon, as has been described above.

The axial information reader and/or the radial information reader are/is designed for electronic, optical, inductive and/or mechanical acquisition of the information of the axially or radially oriented information carrier section.

In a preferred embodiment, the axial information reader has an acquisition element and the acquisition device is designed in such a way that at least part of the acquisition element can be inserted in the axial direction into a recess, in particular groove, in the piston head of the piston-cylinder unit, the recess extending in the axial direction of the piston-cylinder unit, and in this way the depth of this recess can be determined. This allows simple and precise acquisition of the encoded information with little susceptibility to error and thus allows a simple and low-cost construction of the acquisition device.

The acquisition element is preferably of a tappet-like and/or pin-shaped design and/or spring-loaded, in particular being elastically preloaded counter to the direction of insertion of the piston-cylinder unit. It is particularly preferred if the dispenser has a locking element, by means of which the acquisition element can be moved into a release position and held or locked there. As soon as the locking element is no longer locking the acquisition element, the spring-loaded acquisition element is moved toward the piston head and, ultimately, pushed into the piston head recess extending in the axial direction. In this case, the axial information reader can determine the distance traveled by the acquisition element, e.g., by means of a device for position determination.

In a likewise preferred embodiment, the radial information reader has a projection, in particular a spring-loaded projection, and the acquisition device is designed in such a way that at least part of the projection can be inserted in the radial direction into a recess on the piston head of the piston-cylinder unit, the recess extending in the radial direction of the piston-cylinder unit and preferably running around in the circumferential direction of the piston-cylinder unit, and in this way the presence of this recess can be determined. This allows simple and precise acquisition of the encoded information with little susceptibility to error and thus allows a simple and low-cost construction of the acquisition device.

The radial information reader preferably has a photoelectric barrier with a light beam source and a sensor for detecting light beams from the light beam source, wherein the photoelectric barrier is arranged in such a way that retraction or insertion of the projection of the radial information reader from or into the radially oriented recess/es can be detected by the photoelectric barrier.

The piston actuator of the dispenser is advantageously designed in such a way that it can engage the piston head of the piston-cylinder unit at the fastening section.

It is preferred if the axial information reader and the radial information reader can in each case be moved into a release position in order to mount the piston-cylinder unit on the dispenser, thus enabling the piston-cylinder unit to be mounted on the dispenser, in particular inserted into the dispenser, in the axial direction without being hindered by the axial information reader and the radial information reader. Thus, the piston-cylinder unit can be mounted on the dispenser in a simple, quick and user-friendly manner without the axial information reader and/or the radial information reader being damaged.

The dispenser preferably has a locking element, which can, in particular, be moved in the axial direction of the dispenser, very particularly counter to the direction of insertion of the piston-cylinder unit, in order to move the acquisition element and/or the projection out of the release position.

The piston actuator can preferably be moved toward the piston head of the piston-cylinder unit until a stop of the acquisition device rests against an end face of the piston head. This movement, which is also referred to as block travel, is used to acquire a reference point on the piston head side. In particular, the reference point indicates the starting point for a determination of the depth of the recess in the axial direction of the piston head.

The dispenser preferably has means, in particular a photoelectric barrier, for mechanical, electronic, inductive and/or optical detection of the mounting of the piston-cylinder unit on the dispenser. As soon as successful mounting of a piston-cylinder unit has been detected, the acquisition of the information of the information carrier sections can begin.

The dispenser according to the invention is preferably a completely autonomous, handheld and motor-operated unit which combines all the components in one housing, irrespective of location. As is conventional, these include a drive, preferably a motor drive, a transmission unit, which converts the rotary motion of the motor into a longitudinal motion of the piston actuator, electronics, a power supply and, of course, a coupling device for connecting the piston of the piston-cylinder unit to the piston actuator.

The system according to the invention (fourth aspect of the invention) has a dispenser of the kind described above and a piston-cylinder unit of the kind described above, designed as an exchangeable part. In this case, the piston-cylinder unit can be mounted releasably on the dispenser by means of a movement at least substantially in the axial direction of the dispenser.

The technical effects of the present invention emerge both in the piston-cylinder unit (axial and radial encoding or axial encoding and a fastening section on the piston head) and in the dispenser (acquisition of the axial and radial encoding or fastening on the piston head). Here, the invention has an effect on the piston-cylinder unit precisely also in the physical properties and functioning thereof. The piston-cylinder unit embodies a significant part of the inventive concept.

Another aspect relates to a method for detecting the type of an exchangeable piston-cylinder unit for a dispenser. In this case, an exchangeable piston-cylinder unit according to the first aspect of the invention and a dispenser having an acquisition device for automatically identifying the type of a piston-cylinder unit mounted on the dispenser are used. In particular, a dispenser of the kind explained above is employed.

The method comprises the following method steps:

a) releasable mounting of the piston-cylinder unit on the dispenser by means of a movement at least substantially in the axial direction of the dispenser;

b) detecting the completion of a successful mounting of the piston-cylinder unit on the dispenser by means of a sensor device;

c) acquiring an information item of the axially oriented information carrier section of the piston-cylinder unit, d) acquiring an information item of the radially oriented information carrier section of the piston-cylinder unit before, after or in at least partial temporal overlap with step c), and e) determining the type of the piston-cylinder unit mounted on the dispenser from the detected information.

By means of the method, it is possible—given the same size of the individual information carrier sections and the same coding method—to exchange the entire space requirement and the amount of encoded information. With the size of the information carrier sections remaining the same, it is thus possible to encode more information. Conversely, a certain amount of information can be encoded within a smaller amount of space. Thus, a compact construction of the piston-cylinder unit can be achieved, for example.

The acquisition of the information can take place electronically, optically, inductively and/or mechanically.

In the method, it is preferable if, before step a) is carried out, an axial information reader of the acquisition device and/or a radial information reader of the acquisition device is moved into a release position, thus enabling the piston-cylinder unit to be mounted on the dispenser, in particular inserted into the dispenser, in the axial direction without being hindered by the axial information reader and the axial information reader.

It is advantageous if the cylinder of the piston-cylinder unit is fixed in step a) of the method.

It is preferable if, after step b), preferably in at least partial overlap with step c) and/or d), a piston head of the piston-cylinder unit is releasably connected to a piston actuator of the dispenser at a fastening section of the piston head. In this way, coupling between the piston actuator and the piston is achieved. It is proven advantageous here if the fastening section is arranged separately from the two information carrier sections, wherein the two information carrier sections are preferably likewise provided on the piston head.

It is preferable if, after step b) and before step c), a reference point on the piston head side is acquired by producing a relative movement between the piston head of the piston-cylinder unit and the piston actuator. In this case, the length of the relative movement can be determined, for example, preferably by means of a device for incremental travel measurement, which can be motor-driven. As an alternative or in addition, the piston actuator can be moved toward the piston head until a stop of the piston actuator rests against an end face of the piston head.

In a preferred embodiment of the method, in step c), a preferably spring-loaded acquisition element of the axial information reader is inserted at least partially into a recess, in particular groove, in the piston head, the recess extending in the axial direction of the piston-cylinder unit, preferably starting from the reference point on the piston head side. During this process and/or thereafter, the depth of this recess is determined, preferably by means of a device for position determination.

In step d), a preferably spring-loaded projection of the radial information reader is inserted at least partially into a recess on the piston head, the recess extending in the radial direction of the piston-cylinder unit and preferably running around in the circumferential direction of the piston-cylinder unit, and the presence of this recess is determined, preferably by means of a photoelectric barrier.

To move the acquisition element and/or the projection out of the release position, a locking element of the dispenser is preferably moved, preferably in the axial direction of the dispenser.

The invention is explained in greater detail below by means of the description of preferred illustrative embodiments, in some cases with references to the drawing. The features described above and/or disclosed in the following description can be combined when required, but can also be implemented independently of one another, even if this is not described expressly in detail.

DETAILED DESCRIPTION OF THE INVENTION

Figure 1:
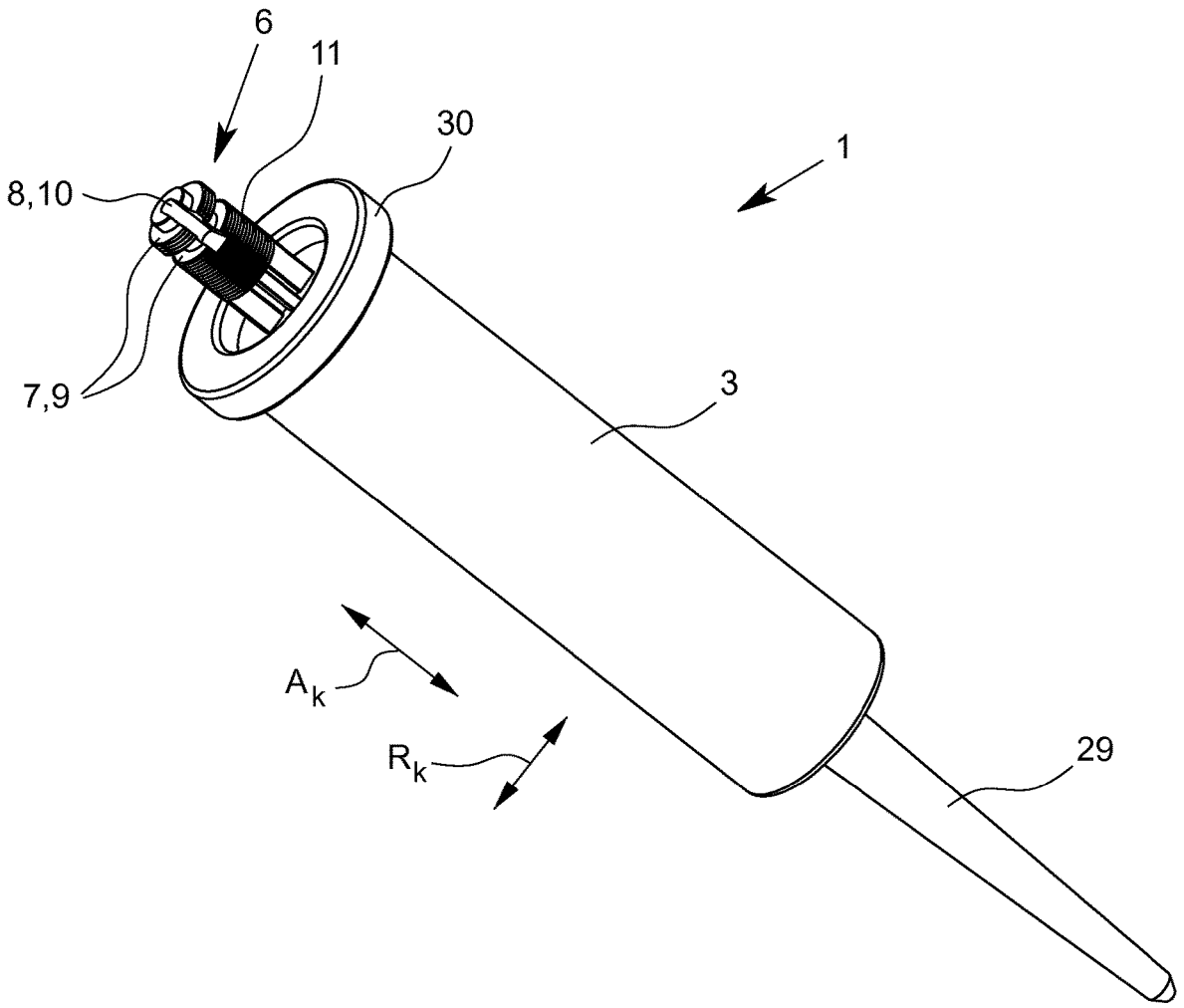
FIG. 1 is a schematic perspective view of a preferred embodiment of a piston-cylinder unit according to the invention.

FIG. 1 shows a preferred embodiment of a piston-cylinder unit 1 according to the invention for a dispenser 2 schematically in a perspective view. The piston-cylinder unit 1 has an axial direction $A_k$ and a radial direction $R_k$ illustrated in FIG. 1.

The piston-cylinder unit 1 is designed as an exchangeable part. It can be in the form of a syringe and can be various sizes with different volumetric capacities. It has a cylinder 3, in which a sealed piston 4 (FIGS. 4-6) can be moved for the purpose of drawing in and expelling a liquid to be pipetted or metered. The piston 4 has a piston rod 5, at one end of which, which projects from the cylinder 3, a piston head 6 is mounted. Only the piston head 6 of the piston 4 is visible in FIG. 1.

The piston-cylinder unit 1 according to the invention has two radially oriented information carrier sections 7, which partially specify the type of the piston-cylinder unit 1, and precisely one axially oriented information carrier section 8, which partially specifies the type of the piston-cylinder unit 1.

In the illustrated preferred embodiment, the radially oriented information carrier sections 7 and the axially oriented information carrier section 8 are arranged on the piston head 6.

Here, the radially oriented information carrier sections 7 are each formed by a recess 9 on the piston head 6, the recess 9 extending in the radial direction $R_k$ of the piston-cylinder unit 1 and running around in the circumferential direction of the piston-cylinder unit 1. The radially oriented information carrier sections 7 are arranged offset relative to one another in the axial direction $A_k$. A distinction can be drawn here between an upper radially oriented information carrier section 7 (arranged on the piston head 6 on the extreme left in FIG. 1) and a lower radially oriented information carrier section 7 (arranged on the piston head 6 further to the right in FIG. 1).

Here, the axially oriented information carrier section 8 is formed by a recess 10 in the piston head 6, the recess being formed as a groove extending in the axial direction $A_k$ of the piston-cylinder unit 1. The axially oriented recess 10 extends in the axial direction $A_k$, starting from an end face of the piston head, and is upwardly open in the axial direction $A_k$, that is to say obliquely upwards to the left in FIG. 1.

Figure 2:
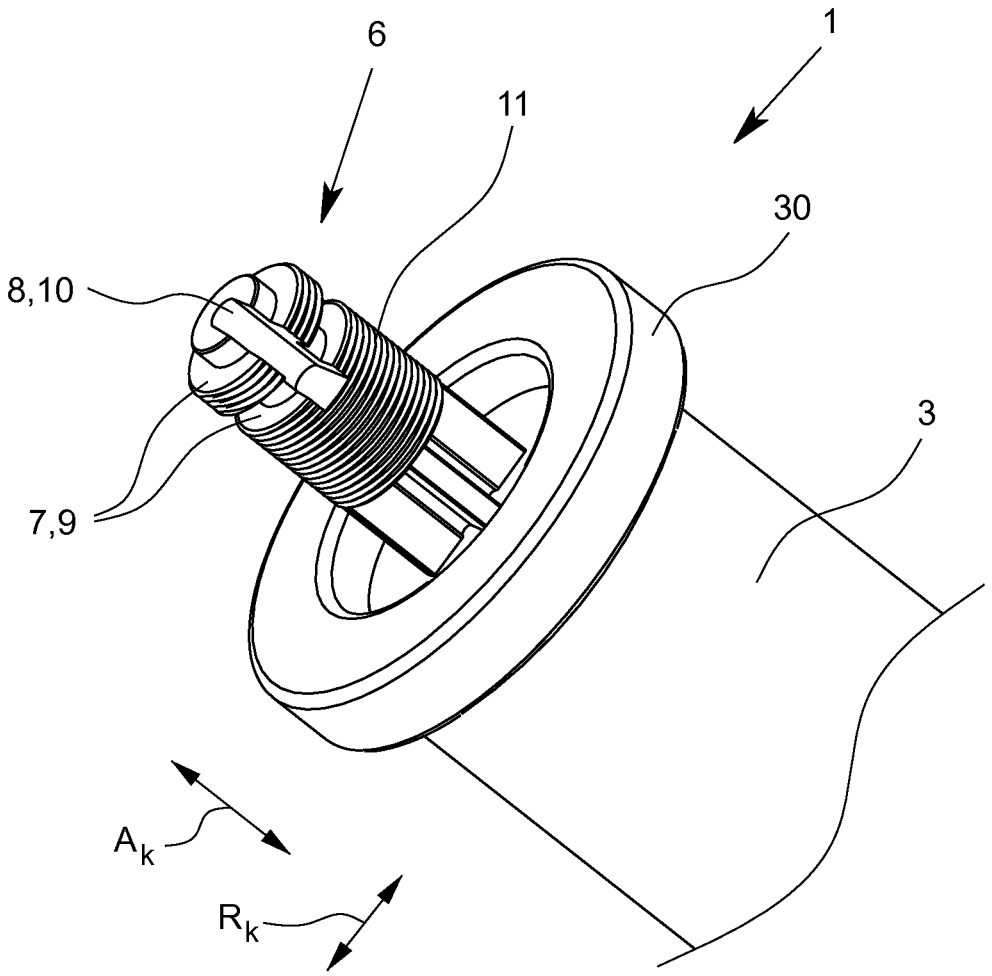
FIG. 2 is an enlarged schematic perspective view of a piston head of the piston-cylinder unit shown FIG. 1.

In FIG. 2, the piston head 6 is illustrated schematically on an enlarged scale in a perspective view. There, it can be seen that the radially oriented recesses 9 are formed by the fact that the piston head has a smaller diameter in these sections.

In the preferred embodiment illustrated, the respective depth or extent of the radially oriented recesses 9 in the radial direction $R_k$ can assume only one particular value, in this case approximately 5 mm. The situation is therefore that the radially oriented recesses 9 are either present at a particular position in the axial direction $A_k$ or not. This also means that, at a depth of 0 mm, this would not be a radially oriented recess in the sense according to the present invention.

Piston-cylinder units 1 of different types can differ, inter alia, in the depth, number, arrangement in the axial direction $A_k$ and/or the respective width (extent in the axial direction $A_k$) of the radially oriented recesses 9.

In FIG. 2, it can also be seen that the axially oriented information carrier section 8 is here designed as an axially oriented recess 10 in the form of a groove. This is therefore not a drill hole surrounded in the radial direction $R_k$. On the contrary, the axially oriented recess 10 is partially open to the outside in the radial direction $R_k$, more specifically along the entire depth of the recess 10. As an alternative, the axially oriented recess 10 can be designed as a blind hole.

In the preferred embodiment illustrated, the recesses 9 are designed in such a way that the depth, number, arrangement in the axial direction $A_k$ and the respective width of the radially oriented recesses 9 specify the type of the piston-cylinder unit 1. In addition, the type of the piston-cylinder unit 1 is specified in the depth (extent in the axial direction $A_k$) of the axially oriented recess 10 and in the information as to whether a radially oriented recess 9 is present or not in a particular axial region of the piston head 6.

Thus, the type of the piston-cylinder unit 1 can be identified by means of a dispenser which acquires only the information of the radially oriented information carrier sections 7 and by means of a dispenser according to the invention.

In the preferred embodiment illustrated, the depth of the axially oriented recess 10 can assume one of several discrete values, e.g., one of eight possible depth values. The discrete depth values have a minimum spacing, preferably about 2 mm. At a depth of 0 mm, this would not be an axially oriented recess in the sense according to the present invention.

In the preferred embodiment illustrated, the axially oriented recess 10 extends over only part of the piston head 6 in the axial direction $A_k$. This allows stable gripping of the piston head 6 without significant deformations of the piston head 6.

In the preferred embodiment illustrated, the two radially oriented information carrier sections 7 and the axially oriented information carrier section 8 partially overlap. In the case of the recesses 9 and the groove 10, this is dependent on the depth of the axially oriented groove 10 and the spacing of the radially oriented recesses 9 from the end face of the piston head 6.

In the preferred embodiment illustrated, the piston head 6 has a fastening section 11, at which a piston actuator 26 of the dispenser 2 can engage the piston head 6. Here, this fastening section 11 is arranged separately from the information carrier sections 7, 8, namely below the radially oriented information carrier section 8 in the axial direction $A_k$. There is no overlap between the fastening section 11 and the information carrier sections 7, 8 here.

The piston-cylinder unit 1 according to the invention allows a compact construction, backward compatibility with older piston-cylinder units and precise movements of the piston 4 by means of the piston actuator 26 without significant deformation of the piston head 6.

Figure 3:
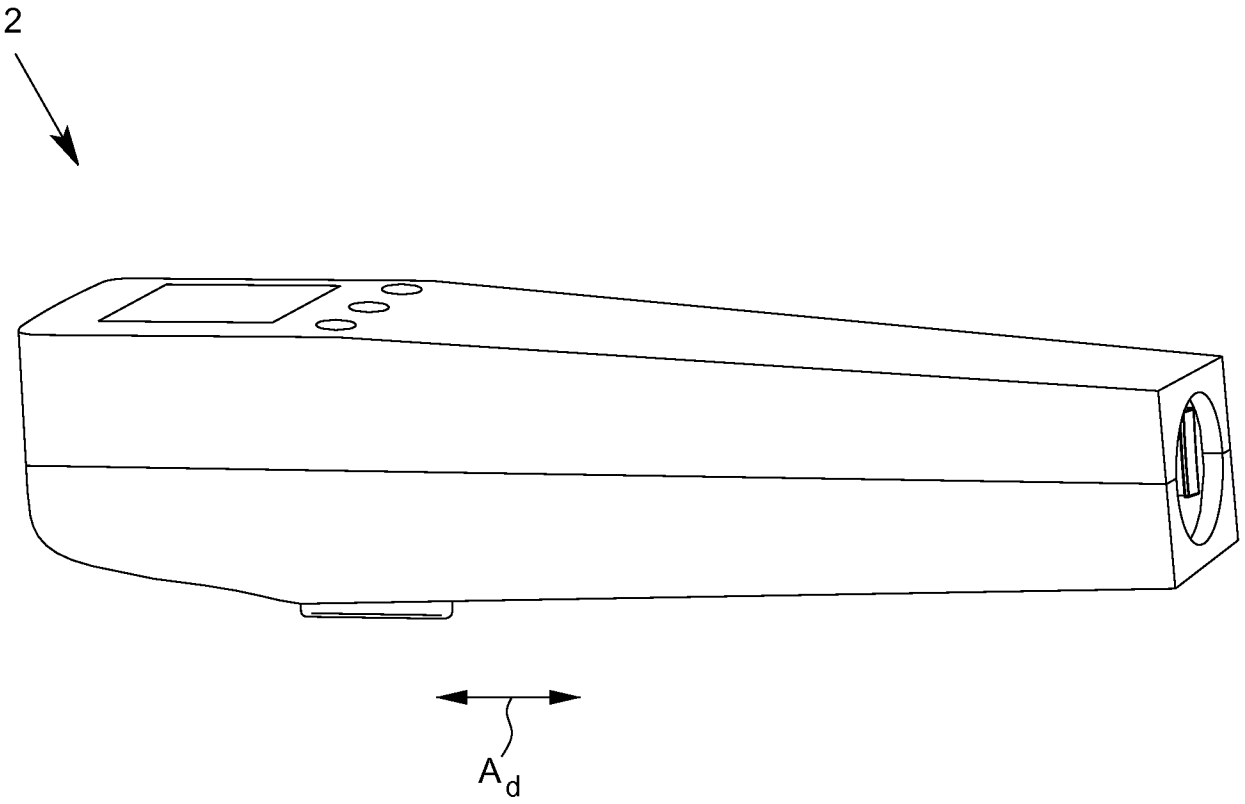
FIG. 3 is a schematic perspective view of a preferred embodiment of a dispenser according to the invention.

FIG. 3 shows a preferred embodiment of a dispenser 2 according to the invention schematically in a perspective view. The dispenser 2 has an axial direction $A_d$ illustrated in FIG. 3.

The dispenser 2 according to the invention has an acquisition device for automatically identifying the type of a piston-cylinder unit 1 mounted on the dispenser 2. The acquisition device has a radial information reader 12, by means of which an information item of the radially oriented information carrier sections 7 of the piston-cylinder unit 1 can be acquired. Moreover, the acquisition device has an axial information reader 13, by means of which an information item of the axially oriented information carrier section 8 of the piston-cylinder unit 1 can be acquired. By means of the acquisition device, the dispenser 2 can identify the type of a piston-cylinder unit 1 mounted thereon.

Figure 4:
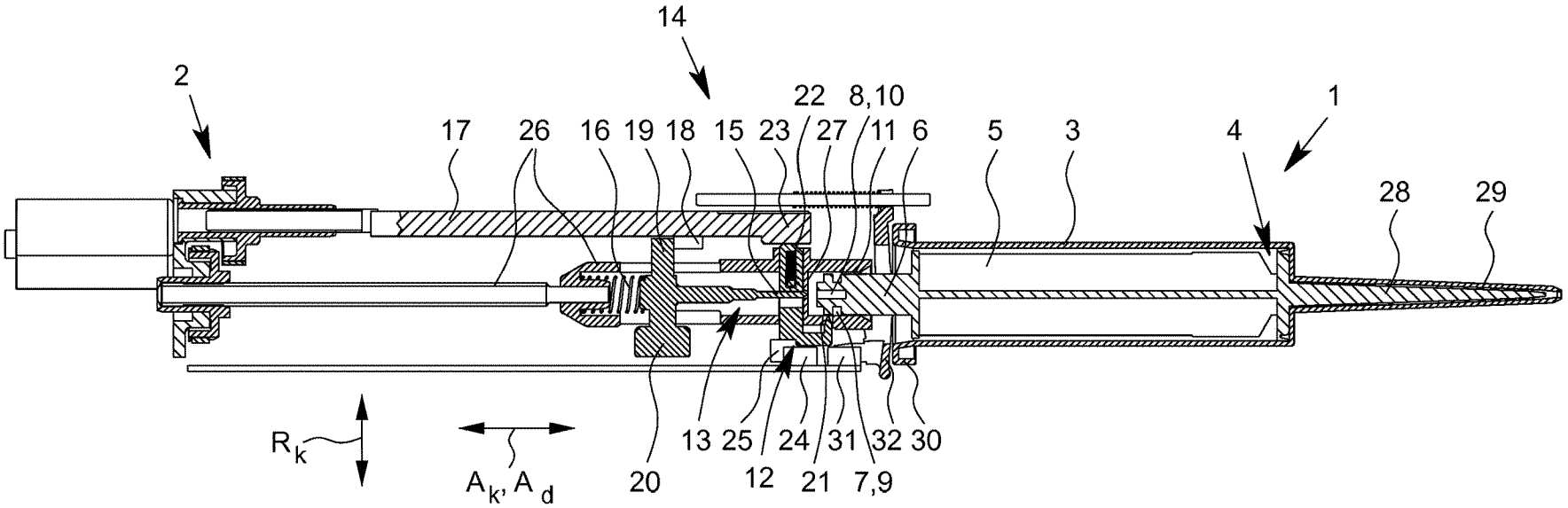
FIG. 4 is a schematic longitudinal sectional view through a preferred embodiment of a system according to the invention with the piston-cylinder unit inserted into a dispenser in a first state, wherein parts of the dispenser have been omitted to simplify illustration.

FIG. 4 shows schematically a longitudinal section through a preferred embodiment of a system 14 according to the invention with the dispenser 2 and the piston-cylinder unit 1 inserted into the dispenser 2 in a first state. Here, the dispenser 2 is illustrated only in part. FIG. 4 is namely restricted to illustrating those components which are required to explain the present invention.

In the preferred embodiment illustrated, the piston 4 has a piston spike 28, which projects into a tip 29 of the piston-cylinder unit 1 in the end position illustrated in FIG. 3 in order to minimize the dead volume.

The cylinder 3 has a flange 30, which rests against a stop element 32 of the dispenser 2. By this means and with the aid of a fixing device (not illustrated), the cylinder 3 is fixed on the dispenser 2, and therefore all that is required to draw in and expel liquid as regards the piston-cylinder unit 1 is that the piston 4 should be movable in the cylinder 3.

In the preferred embodiment illustrated, the axial information reader 13 has an acquisition element 15 and the acquisition device is designed in such a way that part of the acquisition element 15 can be inserted in the axial direction $A_k$ into the axially oriented groove 10 of the piston-cylinder unit 1, and in this way the depth of this groove 10 can be determined.

Here, the acquisition element 15 is elastically preloaded counter to the direction of insertion of the piston-cylinder unit 1 by means of a spring 16. The dispenser 2 has a locking element 17, by means of which the acquisition element 15 can be moved into a release position and held there. The locking element 17 holds the acquisition element 15 in the release position in that a fixing element 18 of the locking element 17 counteracts the force of the spring 16 at an extension 19 of the acquisition element 15 and blocks a movement of the acquisition element 15 in the direction of the spring force (that is to say toward the piston-cylinder unit 1 in the axial direction $A_d$).

The locking element 17 can be moved in the axial direction $A_d$ in the dispenser 2 and relative to the acquisition device. When the locking element 17 is moved in the direction of the piston-cylinder unit 1, a movement of the acquisition element 15 is no longer blocked, and therefore the acquisition element 15 is pushed toward the piston head 6 and then into the axially oriented recess 10 of the piston head 6 by the spring 16 until the acquisition element 15 strikes the end of the recess 10 and is blocked there.

In the preferred embodiment illustrated, the acquisition device has a device for determining the position of the acquisition element 15. This device for position determination comprises a position element 20, which is arranged on the acquisition element 15, opposite the extension 19. By means of this device for position determination, the distance of the relative movement of the acquisition element 15 toward the piston head 6—i.e. the distance which the acquisition element 15 travels out of the release position and/or from a reference point on the piston head side to the end of the axially oriented recess 10.

In the preferred embodiment illustrated, the radial information reader 12 has a projection 21 and the acquisition device is designed in such a way that part of the projection 21 can be inserted in the radial direction $R_k$ into the radially oriented recess 9 of one of the two radially oriented information carrier sections 7 of the piston-cylinder unit 1, namely into the lower radially oriented recess 9, and in this way the presence of this recess 9 can be determined.

In the preferred embodiment illustrated, the radial information reader 12 has precisely one projection 21 and the projection 21 of the radial information reader 12 can be moved in the radial direction $R_k$ toward the piston head 6 only at one particular axial position. Here, therefore, the radial information reader 12 cannot read out all the information of all the radially oriented information carrier sections 7 (cannot be inserted into all the radially oriented recesses 9). On the contrary, the radial information reader 12 can detect whether a radially oriented recess 9 is present or not in a particular axial region of the piston head 6 when a piston-cylinder unit 1 is mounted on the dispenser. As an alternative, provision can be made for the radial information reader 12 to have a plurality of projections 21 that can be moved independently of one another and/or to enable it to be moved in the radial direction $R_k$ toward the piston head 6 at several axial positions.

In the preferred embodiment illustrated, the projection 21 of the radial information reader 12 is elastically preloaded in the radial direction $R_k$ by means of a spring 22. By means of the locking element 17, the projection 21 can be moved into a release position and held there. The locking element 17 holds the projection 21 in the release position in that a sliding block element 23 of the locking element 17 counteracts the force of the spring 22 at the radial information reader 12 and blocks a movement of the projection 21 in the direction of the spring force (that is to say toward the piston head 6 in the radial direction $R_k$).

If the locking element 17 is moved by a sufficient amount relative to the radial information reader 12 in the direction of the piston-cylinder unit 1, a movement of the projection 21 is no longer blocked, and therefore the projection 21 is moved toward the piston head 6 by the spring 22. If there is a radially oriented recess 9 on the corresponding axial region of the piston head 6, the projection 21 is pushed into this radially oriented recess 9 of the piston head 6, where applicable until the projection 21 strikes the end of the recess 9 and is blocked there. In the preferred embodiment of the piston-cylinder unit 1 which is illustrated, there is a radially oriented recess 9, namely the lower radially oriented recess 9, on the corresponding axial region of the piston head 6.

If the locking element 17 is moved by a sufficient amount counter to the direction of insertion of the piston-cylinder unit 1, the acquisition element 15 and the projection 21 can be moved into the release position. In the release position, the piston-cylinder unit 1 can be inserted into or removed from the dispenser 2 in the axial direction $A_d$ without being hindered by the radial information reader 12, in particular by the projection 21 thereof, and by the axial information reader 13, in particular by the acquisition element 15 thereof.

In the preferred embodiment illustrated, the radial information reader 12 has a photoelectric barrier 24 having a light beam source and a sensor for detecting light beams from the light beam source. The photoelectric barrier 24 is arranged in such a way that the photoelectric barrier 24 can detect whether or not the projection 21 of the radial information reader 12 has been inserted into a radially oriented recess 9 of the piston head 6. Here, the photoelectric barrier 24 is arranged immovably in the dispenser 2. A bar 25, which is moved synchronously with the projection 21, is provided on the radial information reader 12. In the release position of the radial information reader 12, the bar 25 interrupts the photoelectric barrier 24. This also applies in the case where there is no radially oriented recess 9. If the projection 21 has been inserted in the radial direction $R_k$ into a radially oriented recess 9, as far as the end thereof, the photoelectric barrier 24 is not interrupted by the bar 25. Thus, the acquisition device can determine whether or not there is a radially oriented recess 9 on the corresponding axial region of the piston head 6.

Figure 5:
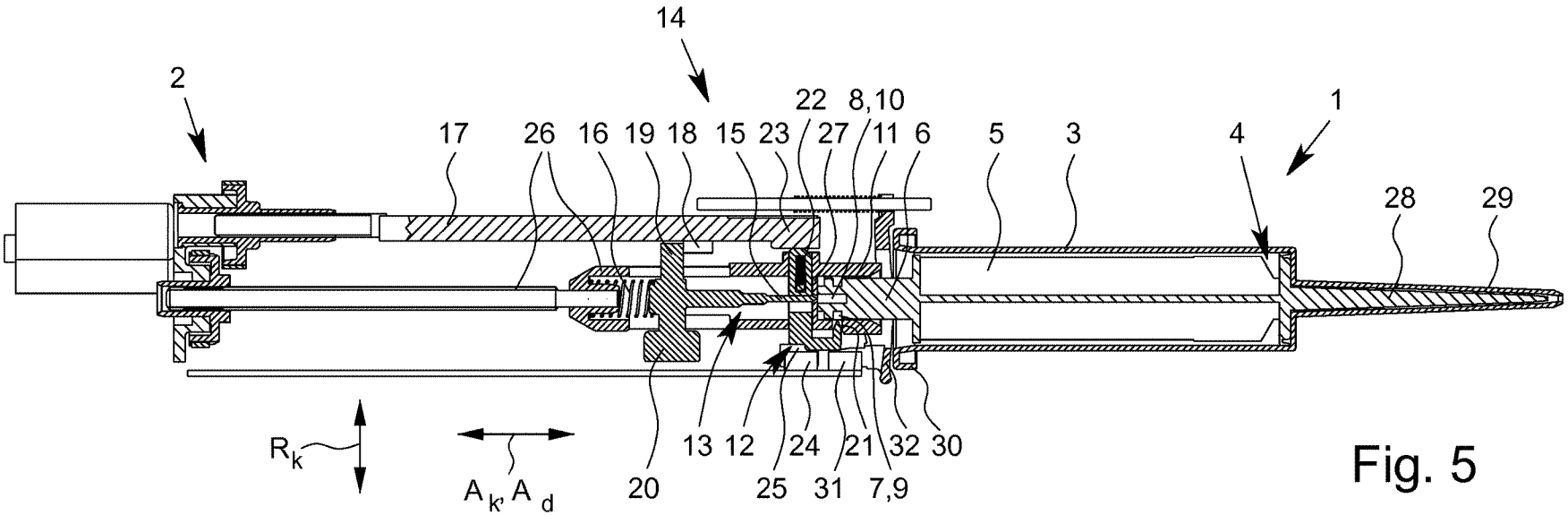
FIG. 5 is a schematic longitudinal sectional view through the system shown in FIG. 4 in a second state.
Figure 6:
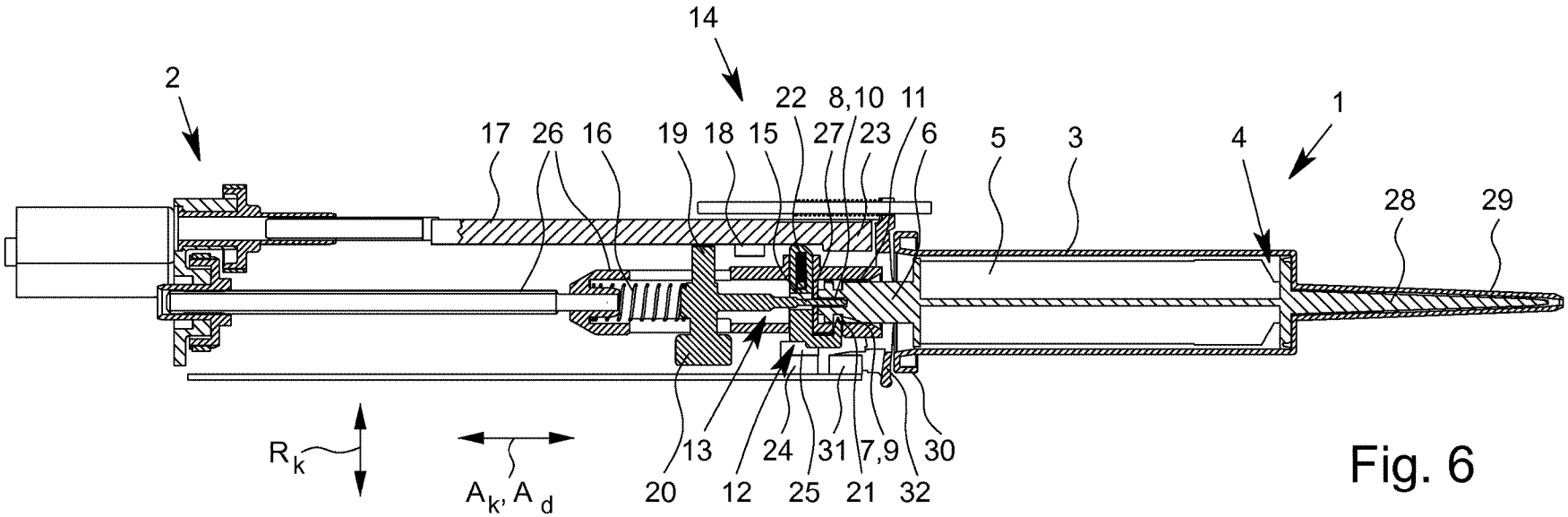
FIG. 6 is a schematic longitudinal sectional view through the system shown in FIG. 4 in a third state.

In the preferred embodiment illustrated, the dispenser 2 has a piston drive device with the piston actuator 26, which is partially visible in FIGS. 4 to 6. The piston actuator 26 is designed in such a way that it can engage the piston head 6 of the piston-cylinder unit 1 at the fastening section 11.

In the preferred embodiment illustrated, the acquisition element 15, the spring 16, the extension 19, the projection 21, the spring 22 and the bar 25 are coupled in terms of movement to the piston actuator 26 or to parts of the piston actuator 26. The piston actuator 26 can be moved toward the piston head 6 of the piston-cylinder unit 1. The movement continues at least until a stop 27 of the piston actuator 26 rests against the end face of the piston head 6. This movement is also referred to as block travel and is used to acquire a reference point on the piston head side. In particular, this reference point indicates the starting point for a determination of the depth of the axially oriented recess 10 of the piston head 6.

The block travel is also used to detect whether the piston 4 has been pushed into the cylinder 3 to the maximum extent or the extent to which the piston 4 has been pushed into the cylinder 3. With the information from the block travel, the piston 4 can, where appropriate, be moved into a starting position, being pushed to the maximum extent into the cylinder 3 for example.

In the preferred embodiment illustrated, the dispenser 2 has a sensor device for detecting the mounting of the piston-cylinder unit 1 on the dispenser 2. A photoelectric barrier 31 is provided as a sensor device here. As soon as successful mounting a piston-cylinder unit 1 has been detected, the acquisition of the information of the information carrier sections 7, 8 can begin.

In the first state, which is illustrated in FIG. 4, the acquisition element 15 and the projection 21 are in the release position. The block travel has not yet been carried out.

FIG. 5 shows schematically a longitudinal section through the system 14 from FIG. 4 in a second state. In this second state, the block travel has been carried out and completed.

FIG. 6 shows schematically a longitudinal section through the system 14 from FIG. 4 in a third state. In this third state, the acquisition element 15 has been inserted into the axially oriented recess 10 as far as the end thereof, and the projection 21 has been inserted into one of the two radially oriented recesses 9, as far as the end thereof.

In the text which follows, a preferred sequence of a method for detecting the type of the exchangeable piston-cylinder unit 1 for a dispenser 2 is described.

First of all, the radial information reader 12 and the axial information reader 13 are moved into the release position, thus allowing the piston-cylinder unit 1 to be inserted into the dispenser 2 in the axial direction $A_d$ without being hindered by the radial information reader 12 and the axial information reader 13.

The piston-cylinder unit 1 is then inserted releasably into the dispenser 2 by means of a movement at least substantially in the axial direction $A_d$ of the dispenser 2. During this process, the cylinder 3 of the piston-cylinder unit 1 is fixed.

If the piston-cylinder unit 1 has been inserted successfully into the dispenser 2, this is detected by means of the sensor device, in this case the photoelectric barrier 31.

The reference point on the piston head side is then acquired by producing a relative movement between the piston head 6 and the piston actuator 26. During this process, the piston actuator 26 is moved toward the piston head 6 until the stop 27 of the piston actuator 26 rests against an end face of the piston head 6 (block travel). The length of the relative movement is determined by means of a motor-driven device for incremental travel measurement.

In the preferred embodiment, the acquisition element 15 and the projection 21 are moved toward the piston head 6 in the axial direction $A_d$ at least partially in temporal overlap, in particular simultaneously, during the block travel.

Acquisition of the reference point on the piston head side represents, as it were, a travel calibration for the subsequent detection of the type of the inserted piston-cylinder unit 1, which makes the method at least to a large extent independent of differences in the dimensional tolerances of the parts of the piston-cylinder unit 1. This is because determination of the reference point in each type detection process opens up the possibility of defining a starting point for reading the information of the information carrier sections 7, 8, on the basis of which, e.g., by the interposition of an invariable starting value defined in the dispenser 2, a target specification can be given to the acquisition device, e.g., as regards the time or travel distance following acquisition of the reference point on the piston head side detection of the information can be expected or is to be carried out.

To acquire the information of the axially oriented information carrier section 8, at least part of the acquisition element 15 of the axial information reader 13 is then inserted into the axially oriented groove 10 of the piston head 6, starting from the reference point on the piston head side. The depth of this groove 10 is determined by means of the position element 20 of the device for position determination.

After this, simultaneously or beforehand, preferably in at least partial temporal overlap, the piston head 6 of the piston-cylinder unit 1 is connected releasably to the piston actuator 26 of the dispenser 2 at the fastening section 11 of the piston head 6. In this way, coupling between the piston actuator 26 and the piston 4 is achieved.

By means of these steps, in at least partial temporal overlap, the information of the radially oriented information carrier section 7 is acquired by inserting at least part of the projection 21 of the radial information reader 12 into that radially oriented recess 9 on the piston head 6 which is at the same level as the projection 21 of the radial information reader 12 in the axial direction $A_d$. The presence of this recess 9 is determined by means of the photoelectric barrier 24.

In order to implement the acquisition of the information in as short a time as possible, the information readers 12, 13 move at least substantially simultaneously. The coupling of the piston 4 can also take place directly after the block travel. To move the acquisition element 15 and the projection 21 out of the release position and to engage the fastening section 11 by means of the piston actuator 26, the locking element 17 of the dispenser 2 is moved in the axial direction $A_d$ of the dispenser 2 as described above, wherein the fixing element 18 and the sliding block element 23 are arranged in mutually coordinated positions.

What is claimed is:

1. A method for detecting the type of an exchangeable piston-cylinder unit for a dispenser, wherein the piston-cylinder unit has at least one radially oriented information carrier section, which at least partially specifies the type of the piston-cylinder unit and which has a geometrical extent in the radial direction by means of which an acquirable information item is encoded, and at least one axially oriented information carrier section, which at least partially specifies the type of the piston-cylinder unit and which has a geometrical extent in the axial direction of the dispenser by means of which an acquirable information item is encoded, and the dispenser has an acquisition device for automatically identifying the type of a piston-cylinder unit mounted on the dispenser, wherein the method comprises:

a) releasably mounting the piston-cylinder unit on the dispenser by means of a movement at least substantially in the axial direction of the dispenser;

b) detecting completion of a successful mounting of the piston-cylinder unit on the dispenser by means of a sensor device;

c) acquiring an information item of the axially oriented information carrier section, d) acquiring an information item of the radially oriented information carrier section, and e) determining the type of the piston-cylinder unit mounted on the dispenser from the information items acquired.

2. The method as claimed in claim 1, comprising, before step a), moving at least part of at least one of a radial information reader of the acquisition device or an axial information reader of the acquisition device into a release position, thus enabling the piston-cylinder unit to be mounted on the dispenser in the axial direction without being hindered by the radial information reader or the axial information reader.

3. The method as claimed in claim 1, comprising, after step b), in at least a partial temporal overlap with at least one of steps c) or d), releasably connecting a piston head of the piston-cylinder unit to a piston actuator of the dispenser at a fastening section of the piston head.

4. The method as claimed in claim 1, wherein, after step b) and before step c), a reference point on the piston head side is acquired by producing a relative movement between a piston head of the piston-cylinder unit and a piston actuator of the dispenser.

5. The method as claimed in claim 4, wherein the length of the relative movement is determined.

6. The method as claimed in claim 4, wherein the piston actuator is moved toward the piston head until a stop of the piston actuator rests against an end face of the piston head.

7. The method as claimed in claim 1, wherein, in step c), an acquisition element of an axial information reader of the acquisition device is inserted at least partially into a groove in a piston head of the piston-cylinder unit, the groove extending in the axial direction of the piston-cylinder unit, and wherein the depth of this groove is determined.

8. The method as claimed in claim 7, wherein insertion of the acquisition element is started from a reference point on the piston head.

9. The method as claimed claim 1, wherein, in step d), a projection of a radial information reader of the acquisition device is inserted at least partially into a recess on a piston head of the piston-cylinder unit, the recess extending in the radial direction of the piston-cylinder unit, and wherein the presence of this recess is determined.

10. The method as claimed claim 9, wherein a photoelectric barrier is used to determine the presence of the radially extending recess.

11. The method as claimed in claim 1, wherein, in step c), an acquisition element of an axial information reader of the acquisition device is inserted at least partially into a groove in a piston head of the piston-cylinder unit, the groove extending in the axial direction of the piston-cylinder unit, wherein the depth of this groove is determined and wherein, to move the axial information reader out of the release position, a locking element of the dispenser is moved.

12. The method as claimed claim 1, wherein, in step d), a projection of a radial information reader of the acquisition device is inserted at least partially into a recess on a piston head of the piston-cylinder unit, the recess extending in the radial direction of the piston-cylinder unit, and wherein the presence of this recess is determined and wherein, to move the radial information reader out of the release position, a locking element of the dispenser is moved.

13. An exchangeable piston-cylinder unit for a dispenser, comprising:

at least one radially oriented information carrier section, which partially specifies the type of the piston-cylinder unit and which has a geometrical extent in a radial direction by means of which an acquirable information item is encoded, and at least one axially oriented information carrier section, which partially specifies the type of the piston-cylinder unit and which has a geometrical extent in an axial direction by means of which another acquirable information item is encoded.

14. The piston-cylinder unit as claimed in claim 13, wherein the radially oriented information carrier section or the axially oriented information carrier section is provided on a piston head of the piston-cylinder unit.

15. The piston-cylinder unit as claimed in claim 13, wherein both of the radially oriented information carrier section and the axially oriented information carrier section are provided on a piston head of the piston-cylinder unit.

16. The piston-cylinder unit as claimed in claim 15, wherein the axially oriented information carrier section is formed by a groove in the piston head that extends in the axial direction of the piston-cylinder unit.

17. The piston-cylinder unit as claimed in claim 15, wherein the radially oriented information carrier section is formed by a recess on the piston head, the recess extending in the radial direction of the piston-cylinder unit.

18. The piston-cylinder unit as claimed in claim 16, wherein the type of piston-cylinder unit is identified by the depth of the radially oriented recess and the depth of the axially oriented groove.

19. The piston-cylinder unit as claimed in claim 14, wherein the piston head has a fastening section which is separate from the information carrier sections and at which a piston actuator of the dispenser is engageable.

20. The piston-cylinder unit as claimed in claim 19, wherein the radially oriented information carrier section is formed by a radially oriented recess on the piston head and wherein the radially oriented recess is arranged between the end face of the piston head and the fastening section.

21. An exchangeable piston-cylinder unit for a dispenser, comprising:

at least one axially oriented information carrier section, which partially specifies the type of the piston-cylinder unit and which has a geometrical extent in an axial direction by means of which an acquirable information item is encoded, and a fastening section, wherein:

the axially oriented information carrier section and the fastening section are provided on a piston head of the piston-cylinder unit, the fastening section is arranged separately from the axially oriented information carrier section, and a piston actuator of the dispenser is engageable with the piston head at said fastening section.

22. The piston-cylinder unit as claimed in claim 21, wherein the axially oriented information carrier section is formed by a groove in the piston head that extends in the axial direction of the piston-cylinder unit.

23. The piston-cylinder unit as claimed in claim 22, wherein the depth of the groove partially specifies the type of the piston-cylinder unit.

24. The piston-cylinder unit as claimed in claim 21, wherein the fastening section is arranged below the axially oriented information carrier section in the axial direction.

25. The piston-cylinder unit as claimed in claim 21, further comprising at least one radially oriented information carrier section on the piston head which partially specifies the type of the piston-cylinder unit and which has a geometrical extent in a radial direction by means of which an acquirable information item is encoded.

26. The piston-cylinder unit as claimed in claim 25, wherein the radially oriented information carrier section is arranged separately from the axially oriented information carrier section.

27. The piston-cylinder unit as claimed in claim 26, wherein the radially oriented information carrier section is arranged between an end face of the piston head and the fastening section.

28. A dispenser, on which a piston-cylinder unit is releasably mountable by means of a movement at least substantially in an axial direction of the dispenser, comprising:

a piston actuator that is connectable to the piston of the piston-cylinder unit, an acquisition device for automatically identifying the type of a piston-cylinder unit mounted on the dispenser, wherein the acquisition device has:

a radial information reader, by means of which an information item of a radially oriented information carrier section of the piston-cylinder unit is able to be acquired, and an axial information reader, by means of which an information item of an axially oriented information carrier section of the piston-cylinder unit is able to be acquired.

29. The dispenser as claimed in claim 28, wherein the radial information reader or the axial information reader is adapted to acquire the information of the radially oriented information carrier section or of the axially oriented information carrier section by any of electronic, optical, inductive or mechanical means.

30. The dispenser as claimed in claim 28, wherein the axial information reader has an acquisition element that is able to be inserted into a groove of a piston head of the piston-cylinder unit in the axial direction, the groove extending in the axial direction of the piston-cylinder unit, and wherein the depth of this groove is determinable by inserting the acquisition element into the groove in the axial direction.

31. The dispenser as claimed in claim 28, wherein the radial information reader has a projection and wherein at least part of the projection is able to be inserted into a recess on a piston head of the piston-cylinder unit in a radial direction, the recess extending in the radial direction of the piston-cylinder unit, and wherein the presence of this recess is determinable by inserting the projection into the recess in the radial direction.

32. The dispenser as claimed in claim 31, wherein the radial information reader has a photoelectric barrier with a light beam source and a sensor for detecting light beams from the light beam source, and wherein the photoelectric barrier is arranged in such a way that insertion of the projection of the radial information reader into the radially oriented recess is detectable by the photoelectric barrier.

33. The dispenser as claimed in claim 28, wherein the piston actuator is engageable with a piston head of the piston-cylinder unit at a fastening section which is separate from the information carrier sections.

34. The dispenser as claimed in claim 28, wherein at least part of the radial information reader and at least part of the axial information reader are movable into a release position for mounting the piston-cylinder unit on the dispenser in the axial direction without being hindered by the radial information reader or the axial information reader.

35. The dispenser as claimed in claim 34, wherein the dispenser has a locking element which is movable in the axial direction of the dispenser in order to move at least one of the axial information reader and the radial information reader out of the release position.

36. The dispenser as claimed in claim 28, wherein the piston actuator is moveable toward a piston head of the piston-cylinder unit until a stop of the piston actuator rests against an end face of the piston head in order to acquire a reference point on the piston head.

37. The dispenser as claimed in claim 28, wherein the dispenser has at least one of mechanical, electronic, inductive or optical means for detection of mounting of the piston-cylinder unit on the dispenser.

38. A system for receiving and dispensing fluid volumes, comprising:

an exchangeable piston-cylinder unit and a dispenser, wherein the piston-cylinder unit comprises:

at least one radially oriented information carrier section, which partially specifies the type of the piston-cylinder unit and which has a geometrical extent in a radial direction by means of which an acquirable information item is encoded, and at least one axially oriented information carrier section, which partially specifies the type of the piston-cylinder unit and which has a geometrical extent in an axial direction by means of which another acquirable information item is encoded, wherein the dispenser comprises:

a piston actuator that is connectable to the piston of the piston-cylinder unit, an acquisition device for automatically identifying the type of a piston-cylinder unit mounted on the dispenser having a radial information reader, by means of which an information item of a radially oriented information carrier section of the piston-cylinder unit is able to be acquired, and an axial information reader, by means of which an information item of an axially oriented information carrier section of the piston-cylinder unit is able to be acquired, and wherein the piston-cylinder unit is releasably mounted on the dispenser by a movement at least substantially in an axial direction of the dispenser.

* * * * *